US007096832B2

(12) United States Patent
Grazioli et al.

(10) Patent No.: US 7,096,832 B2
(45) Date of Patent: Aug. 29, 2006

(54) COMBUSTION—POWERED WORKING TOOL, IN PARTICULAR A SETTING TOOL FOR FASTENING ELEMENTS

(75) Inventors: Mario Grazioli, Chur (CH); Gebhard Gantner, Nenzing (AT); Norbert Pfister, Montlingen (CH)

(73) Assignee: Hilti Aktiengesellschaft, Schaan (LI)

( * ) Notice: Subject to any disclaimer, the term of this patent is extended or adjusted under 35 U.S.C. 154(b) by 279 days.

(21) Appl. No.: 10/738,325

(22) Filed: Dec. 17, 2003

(65) Prior Publication Data

US 2004/0182334 A1 Sep. 23, 2004

(30) Foreign Application Priority Data

Dec. 19, 2002 (DE) ..... 102 59 777

(51) Int. Cl.
*F02B 71/00* (2006.01)

(52) U.S. Cl. ..... 123/46 SC; 123/46 H; 227/10

(58) Field of Classification Search ..... 123/460, 123/46 H, 46 SC; 227/8, 9, 10, 11
See application file for complete search history.

(56) References Cited

U.S. PATENT DOCUMENTS 5,213,247 A * 5/1993 Gschwend et al. ..... 227/10

* cited by examiner

*Primary Examiner*—Tony M. Argenbright
*Assistant Examiner*—Katrina Harris

(74) *Attorney, Agent, or Firm*—Abelman, Frayne & Schwab

(57) ABSTRACT

The invention describes a combustion—operated working tool, in particular a setting tool for fastening elements, having a guide cylinder (5) axially displaceable relative to the device housing (1); a piston (9) displaceably mounted in the guide cylinder (6); a housing—integral stop (8), which projects into the guide cylinder (5) to delimit an engagement part of the piston (9) in the direction of advance of the piston (6), when the guide cylinder (5) is shifted in the direction of advance of the piston (6); and an elastic adjusting element (21–23), which is tensioned upon moving the guide cylinder (5) into the device housing (1) and by virtue of which an engagement part (28, 31) can be driven for carrying the piston (9) opposite to the direction of advance of the piston (6), after extension of the guide cylinder (5) out of the device housing (1).

14 Claims, 6 Drawing Sheets

COMBUSTION—POWERED WORKING TOOL, IN PARTICULAR A SETTING TOOL FOR FASTENING ELEMENTS

BACKGROUND OF THE INVENTION

The invention relates to a combustion-driven working tool, which is configured as a setting tool for fastening elements, a guide cylinder axially displaceable relative to the device housing; a piston mounted displaceably in the guide cylinder; a stop integral with the device housing, which projects into the guide cylinder to delimit an engagement of the piston in the direction of advance of the piston when the guide cylinder is shifted in the direction of advance of the piston; and an elastic adjusting element, which is tensions upon moving the guide cylinder into the device housing and by virtue of which, after extension of the guide cylinder out of the device housing an engagement part for engagement of the piston can be driven opposite to the direction of advance of the piston. It can be a working tool operated using fuel gas or a working tool operated using powder charge, to which cartridges are supplied.

In a conventional device, the extension movement of the device is used for piston return. Stated more precisely, for this purpose after execution of a setting operation, by means of a spring, a guide cylinder receiving the piston is moved forward; that is, towards the muzzle of the working tool or in the direction of advance of the piston, relative to the housing. Then, engaging parts or latches attached to the housing hold the piston back such that upon the extension movement of the guide cylinder, it moves rearward into its starting position; that is, in the direction opposite to that of the direction of advance of the piston.

In this solution, the drawback is that for resetting a specific piston stroke, the extension/contact movement must correspond at least to the length of the piston stroke. The contact stroke is accordingly relatively large. If the stroke is kept small, only short piston strokes can be executed.

SUMMARY OF THE INVENTION

The object of the invention is to provide a fuel gas operated working tool of the aforesaid type, wherein a large piston stroke can be executed with a small contact stroke.

The solution of this object is achieved by a fuel gas operated working tool according to the invention, in particular a setting tool for fastening elements, comprising a guide cylinder that is axially displaceable relative to a device housing; a piston mounted in the guide cylinder; a stop that is affixed to the housing and protrudes into the guide cylinder to delimit an entrainment of the piston in the direction of piston advance when the guide cylinder is shifted in the direction of piston advance; and an elastic adjusting element, which is biased upon retraction of the guide cylinder into the housing and by which, after extension of the guide cylinder from the device housing, an engaging part for entrainment of the piston can be driven in the direction opposite to that of piston advance.

An extension spring is tensioned to be able to shift the guide cylinder forward again relative to the device housing, after execution of the setting operation and removal of the working tool from the object when pressing the working tool against an object, into which a fastening element is to be driven. After a successful setting, wherein the fastening element is driven in, the extension spring pushes the guide cylinder, in the direction of the muzzle, forward, whereby the piston is held by latches or engagement parts relative to the housing and, when this is done, moved back relative to the guide cylinder. This extension movement of the guide cylinder forward or in the direction of advance of the piston, however, covers only half of the piston stroke. With the movement of the guide cylinder forward, then, the piston is moved back only up to the half of its stroke in the guide cylinder. Once this position has been reached, the piston is then urged back into its starting position by the elastic adjusting element, which otherwise is tensioned upon pressing the working tool against the work piece, and the piston has thus reached its rearmost position in the guide cylinder. The engagement piece is used in this process, which is appropriately operated by the elastic adjusting element.

Thus, in the working tool according to the invention, initially the pressing stroke of the guide cylinder is stored and the extension stroke of the guide cylinder moves the piston back by over half of its piston stroke. The stored extension stroke then assumes the second half of the piston return travel. In this fashion, with a defined pressing/extension stroke of the guide cylinder a double return stroke can be provided.

According to an advantageous embodiment of the invention, the engagement part can be pivoted and displaced on the guide cylinder or it can be solely displaceable. In this case the engagement part in its position when moved out of the guide path can be locked and then released again, after the guide cylinder has been shifted in the direction of advance of the piston and the engagement part has again reached its piston engagement position. After release, the engagement part engages the piston and guides it back into its starting position by virtue of the action of the elastic adjusting element, said position being at the end of the guide cylinder situated opposite to the direction of advance of the piston.

The elastic adjusting element can be arranged between the guide cylinder and the engagement part, wherein an elastic element can be utilized such as a compression spring or an elastically mounted ram part.

BRIEF DESCRIPTION OF THE INVENTION

Exemplary embodiments of the invention are described in more detail in the following with reference to the drawings, wherein.

DETAILED DESCRIPTION OF THE INVENTION

Figure 1:
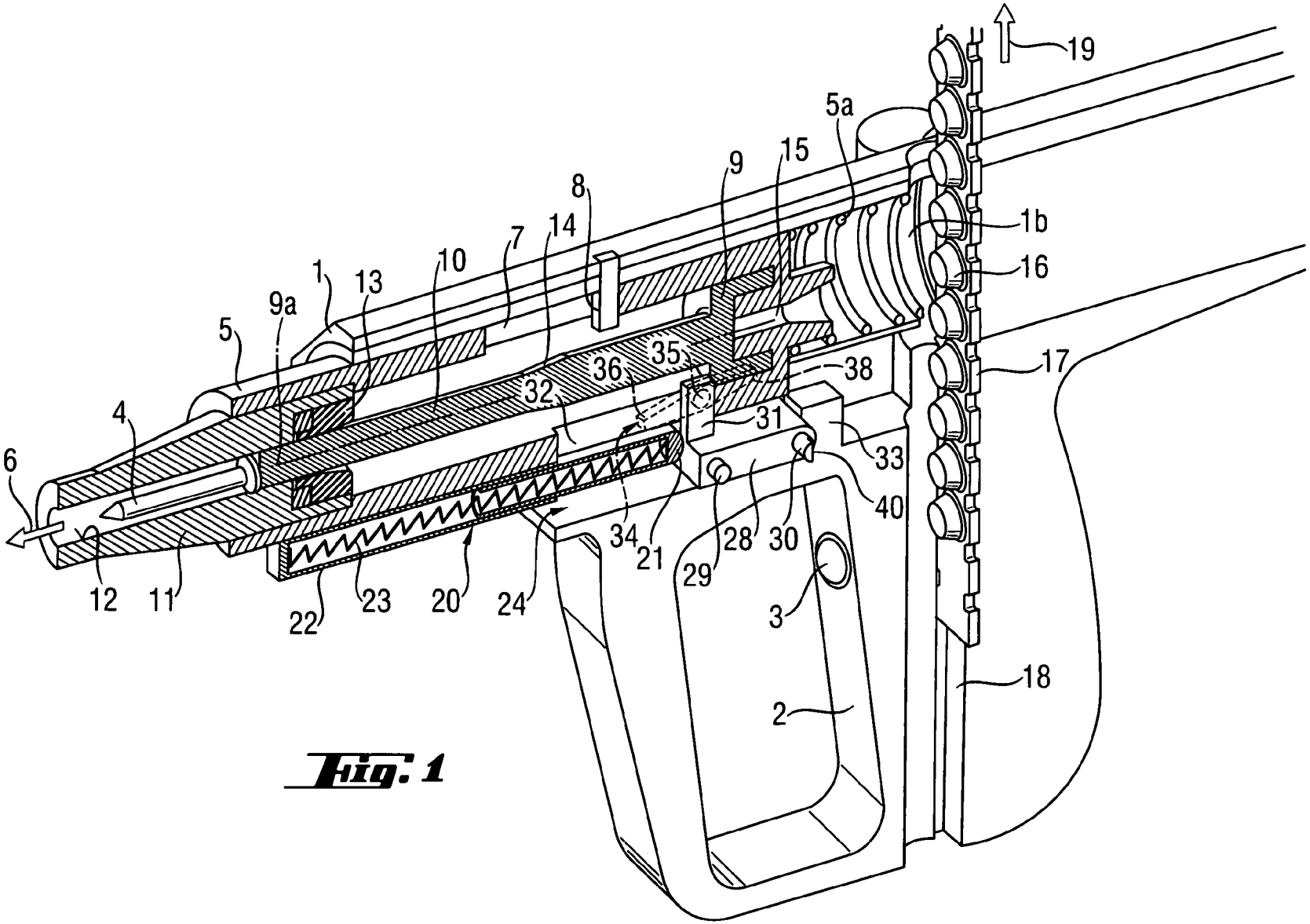
FIG. 1 shows an axial section through a working tool according to a first exemplary embodiment and represented in perspective.

FIG. 1 shows a working tool according to the invention in perspective axial section according to the first exemplary embodiment, which is configured as a powder—actuated working tool. The working tool comprises a device housing 1 having a grip 2 for holding the working tool in an operating position and a trigger 3 for firing the working tool to set the fastening element 4 driving it into an object (not shown).

Inside the device housing 1, a guide cylinder 5 is slidingly displaceably mounted in its axial direction, which lies parallel to the direction of advance of the piston, which is indicated in FIG. 1 by the reference 6. The guide cylinder 5 has an axial longitudinal slot 7, into which a stop 8 integrally fixed with the device housing protrudes. The stop 8 is fixed to the device housing 1 and allows only an axial displacement of the guide cylinder 5 over a pre-determined path, which corresponds to the axial length of the longitudinal slot 7. In this case, the stop 8 protrudes in part into the cylindrical hollow space of the guide cylinder 5.

A piston 9 is mounted in the guide cylinder 5 and can be axially displaced in the guide cylinder 5. The piston 9 has an external diameter that corresponds approximately to the inside diameter of the guide cylinder 5 and can be sliding displaced in a zone within same, said zone being situated between the stop 8 and the rear end of the guide cylinder 5 in the direction of advance of the piston 6. The stop 8 thus delimits the travel of the piston 9 in the direction of advance of the piston 6. Preferably, in the direction of advance of the piston 6, a piston rod 10 is connected in one piece with the piston 9. The piston rod 10 is fitted through a piston guide 11, which is inserted into the free end or the forward end of the guide cylinder 5. The piston rod 10 is thus received by a passage channel 12 of the piston guide 11, in which the fastening element 4 comes to rest upstream of the front surface of the piston rod 10. A supply system (not shown) is used for supplying fastening elements 4 into the passage channel 12. A braking element 13 is arranged at the rear end of the piston guide 1 in the direction of advance of the piston 6, said braking element arresting the movement of the piston 9 in the direction of advance of the piston 6, when a corresponding thickening or bevel 14 acts upon the braking element 13. If this is the case, the piston 9 has not yet reached the stop 8.

The rear end of the piston 9 is configured to be pot-shaped in the direction of advance of the piston 6 and overlaps a central firing chamber 15, when the piston 9 is in its starting position; that is, when the piston 9 is situated at the opposite rearward end of the guide cylinder 5. The firing chamber 15 expands conically opposite to the direction of advance of the piston 6 to receive the firing cartridge 16, when the guide cylinder 5 is moved to its farthest point opposite to the direction of advance of the piston. A plurality of such firing cartridges 16 are connected to form a cartridge belt 17, which is passed through the device housing 1 along the guiding track 18. The transport direction of the cartridge belt 17 is provided in FIG. 1 with the reference 19 and is situated vertical to the direction of travel of the piston 6. After each setting operation, the cartridge belt 17 is transported in the transport direction 19 by the space between two cartridges 16 to bring a new cartridge into the firing position.

A spring 5*a* is arranged between the rear end of the guide cylinder 5 and a rear housing stop 1*b*, said spring supporting the rear housing stop 1*b* and urging the guide cylinder forward or in the direction of advance of the piston 6. This continues until the rear surface of the longitudinal slot 7 in the direction of advance of the piston 6 runs up against the stop 8. Then the guide cylinder 5 reaches its idle position. Upon pressing the working tool against an object, the guide cylinder 5 is shifted inside the device housing and when this is done, the spring 5*a* is compressed to drive the guide cylinder 5 forward again after the setting operation is completed.

An elastic adjusting element 20 is fixed with the guide cylinder 5. In this case, it lies in the zone between the guiding cylinder 5 and the handle 2. The elastic adjusting element 20 has a ram 21, which is configured as a hollow cylinder closed at one end, and a ram chamber 22, in which the ram 21 is axially sliding displaceably mounted. The ram chamber 22 is fixed with the guide cylinder 5. A ram spring 23 is arranged inside the ram 21 and the chamber 22, said spring being configured as a helical spring. The ram spring 23 tends to push out the ram 21 axially against the direction of advance of the piston 6 from the ram chamber 22. The axial direction of the ram 21 and the ram chamber 22 lie parallel to the cylinder axis of the cylinder of the guide cylinder 5. The ram spring 23 thus tends to urge the ram to the rear end of the working tool; to the end opposite situated opposite to the piston guide 11 or muzzle of the working tool.

A recess 24 is situated Inside the device housing 1 and in the zone between the handle 2 and the guide cylinder 5; the longitudinal axis of the recess lying parallel to the central axis of the guide cylinder 5. On the one hand, the ram 21 projects into this recess 24 opposite to the direction of advance of the piston 6. On the other hand, a piece 25 comes to rest in the recess 24, said part being displaceably mounted in the longitudinal direction of the recess 24. The connecting piece 25 is fixed with the guide cylinder 5. Thus, if the guide cylinder moves in its axial direction, the connecting piece 25 is carried along in the recess 24. For the sake of clarity the connecting piece 25 is not shown in FIG. 1 and can best be seen in FIG. 2. According to FIG. 2, a longitudinal groove 26 is found in the connecting piece 25 that extends in the direction of advance of the piston 6 and whose forward end 27 in the direction of advance of the piston 6 is angled away from the axis 9*a* of the piston 9 or the guide cylinder 5. The longitudinal slot 26 lies parallel to the longitudinal axis of the guide cylinder 5.

An engagement part 28 is situated lateral to the connecting piece 25. The engagement part 28 is cuboid and can also be moved in the longitudinal direction of the slot 24. Axial stubs 29, 30 are oriented towards the connecting piece 25 and engage in the longitudinal slot 26 of the connecting piece 25 and can be guided over the engagement part 28 along the connecting piece 25. The connecting piece 25, which can be configured as a platelike element, lies in FIG. 1 behind the engagement part 28, whereby in FIG. 1 the axial stubs 29, 30 also extend towards the rear. These can also be penetrating fixed axes. The engagement part 28 can thus be moved by the axial stubs 29, 30, which are received by the longitudinal slot 26, along the connecting piece 25, and can also be pivoted, when the axial stub 29 reaches into the forward part 27 of the longitudinal slot 26 and the axial stub 30 continues to remain in the horizontal zone of the longitudinal slot 26. A flange or boss 31 is fixed to the engagement part 28, which faces in the direction of the guide cylinder 4 and engages in same. The guide cylinder 5 has a second axial slot 32, through which the boss 31 protrudes. The boss 31 engages into the interior of the guide cylinder that it can grip the piston. Viewed in the direction of advance of the piston 6, it comes to lie in front of the piston.

The engagement part 28 biased by the ram 21, which tends to urge it in the direction towards the rear end of the working tool 1. However, a stopper 33 is arranged in the path of the engagement part 28 and is fixed to the handle 2 or the device housing 1. The ram 21 can therefore urge the engagement part 28 only up to and against the stopper 33. The connecting piece 25 can laterally pass by the stopper 33.

Figures 2, 3:
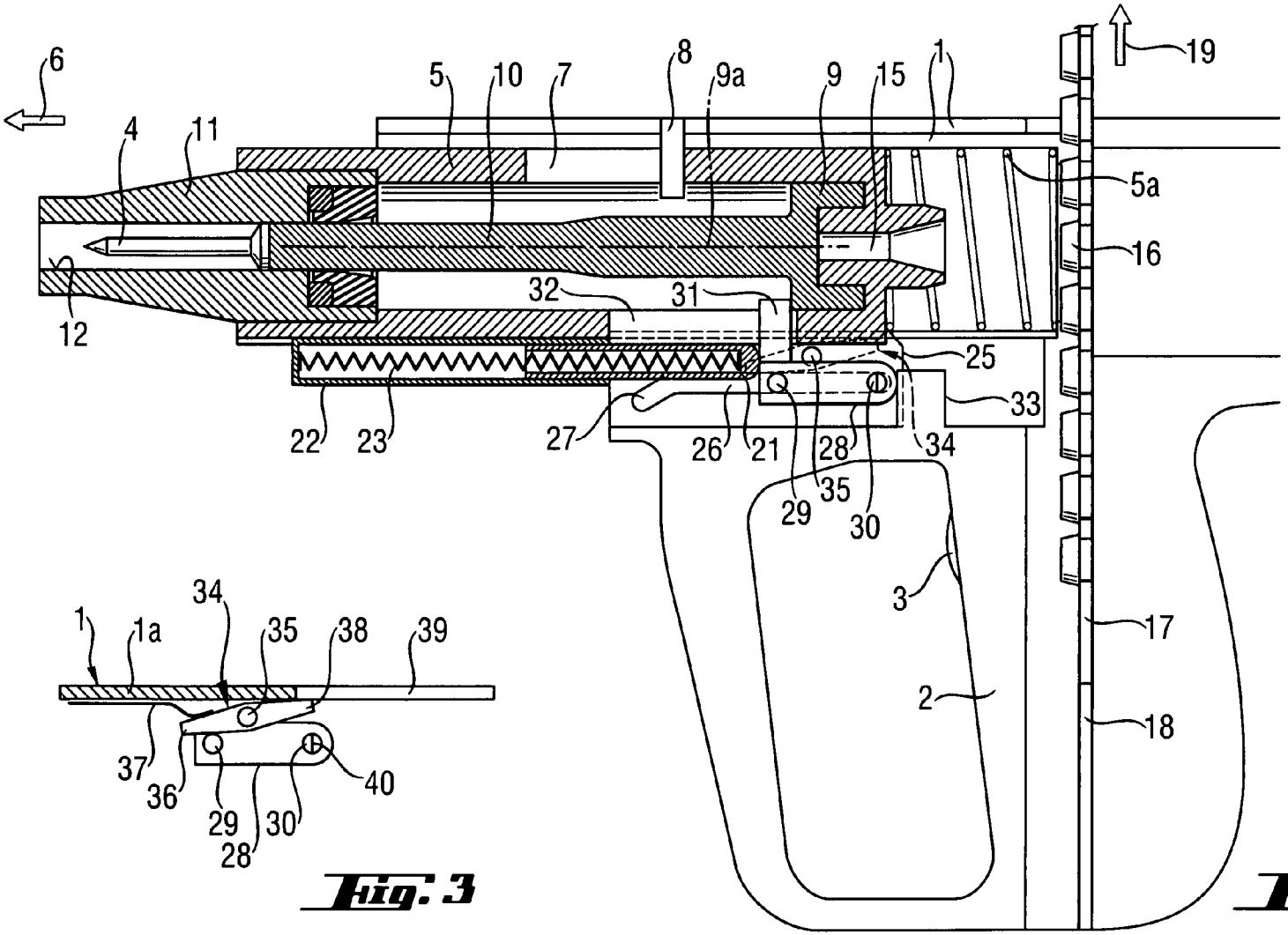
FIG. 2 shows the working tool of FIG. 1 in section in the non-pressed state.
FIG. 3 shows the position of a locking latch in the state of FIG. 2.

A locking latch 34 that can be pivoted about an axis 35 is also mounted on the guide cylinder and stands vertical to the longitudinal axis of the guide cylinder 5. The locking latch 34 is configured as a centrally mounted swivel bar, which participates in the movement of the guide cylinder 5. The end 38 of the swivel bar situated forward in the direction of advance of the piston 6 is urged away from the guide cylinder 5 by a compression spring 37, as can be seen in FIG. 3. The compression spring 37 is affixed to the guide cylinder. The end 38 of the swivel bar 34 situated opposite impacts against a wall of the device housing 1*a*. Inasmuch, the away movement of the end 36 of the guide cylinder is initially stopped as a result of the effect of the spring 37. Nevertheless, a longitudinal slot 39 is situated in the wall of the device housing, which runs in the axial direction of the guide cylinder 5 and in a corresponding relative position can insert into the end 38 of the swivel bar 34. This will be described in more detail in connection with FIGS. 4 and 5. The swivel bar or the locking latch 34 is situated on the side of the engagement part 28 facing away from the connecting piece 25, whereby this side of the axis stub 30, is provided with a tangential surface 40. If the axial stub 29 of the engagement part 28 projects into the forward zone 27 of the longitudinal slot 26, the engagement part 28 is pivoted relative to the connecting piece, then the tangential surface 40 swivels such that, in the corresponding position of the locking latch 34 relative to the engagement part 28, it comes to lie opposite to the tangential surface 40. Accordingly a locking of the engagement part occurs.

The mode of operation of the working tool configured according to the first exemplary embodiment of the invention will now be described in more detail with reference to FIGS. 2 to 7.

According to FIGS. 2 and 3, the working tool is in the idle state. Thus, it is not pressed with its muzzle or piston guide 11 against an object. The guide cylinder 5 is displaced at the farthest point in the direction of advance of the piston 6 and impacts against the stop 8, which engages in the axial longitudinal slot 7 of the guide cylinder 5. The guide cylinder 5 by virtue of the extension spring 5*a* is urged against this stop 8, which on the one hand abuts on the guide cylinder and on the other hand abuts on the device housing boss 1*b*. The engagement part 28 now lies with its axial stubs 29, 30 in the rear zone of the longitudinal slot 26 of the connecting piece 25 such that the boss 31 connected to the engagement part 28 protrudes through the axial slot 32 into the inside of the guide cylinder 5 and grips the piston 9 or holds it in its idle position. In this idle position, the pot-shaped piston covers the firing chamber 15, which as a result of the displacement of the guide cylinder 5 forward is not occupied by a cartridge 16.

According to FIG. 3, the rear end 38 of the locking latch 34 strikes from below against the wall 1*a* of the device housing 1 and thus does not project into the longitudinal slot 29 in the wall 1*a*, such that the compression spring 27 initially remains without effect and the forward end 36 of the locking latch 34 cannot pivot into the track of the axial stubs 29, 30.

Figure 4:
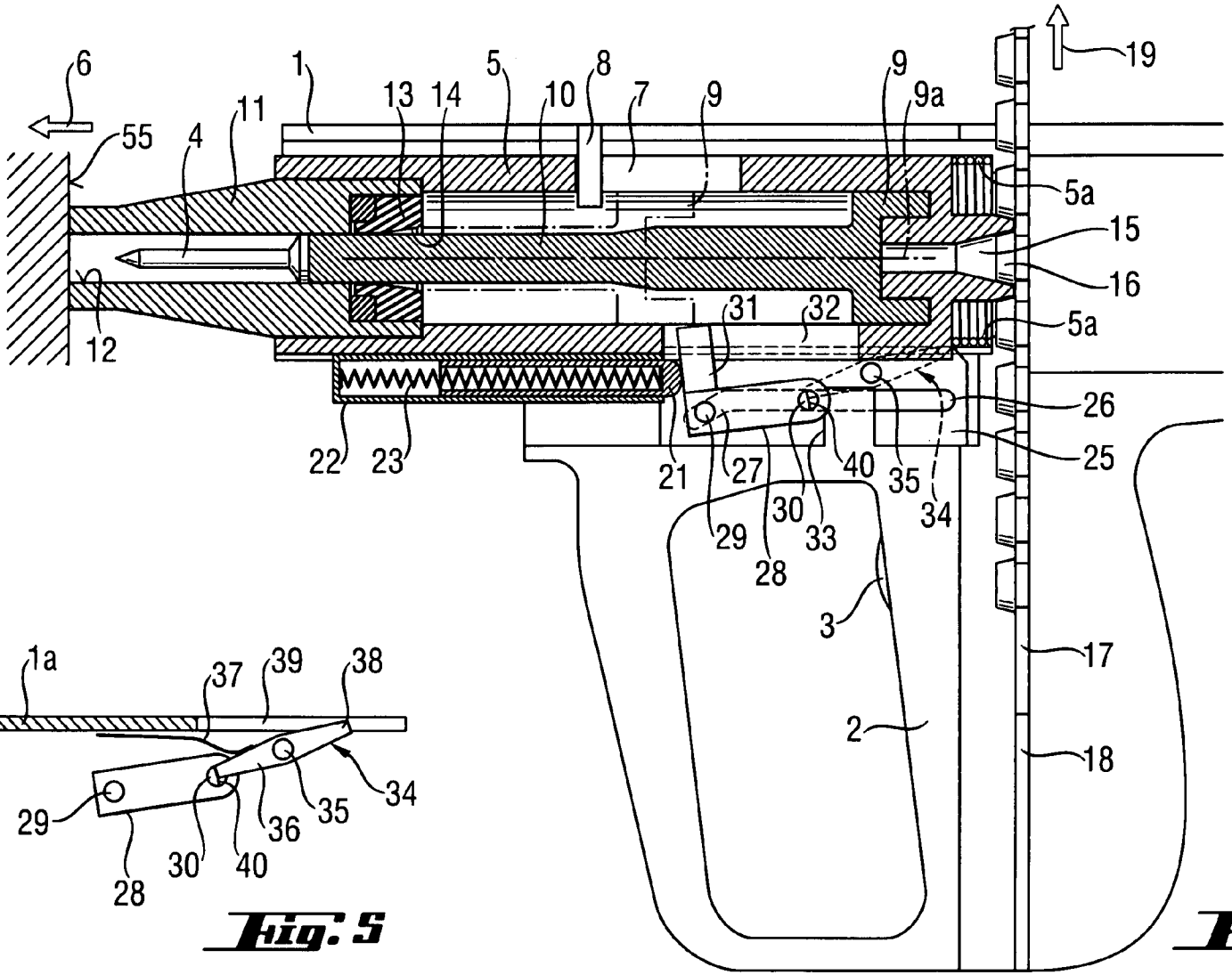
FIG. 4 shows the working tool in section in the pressed state before and after a setting operation.
Figure 5:
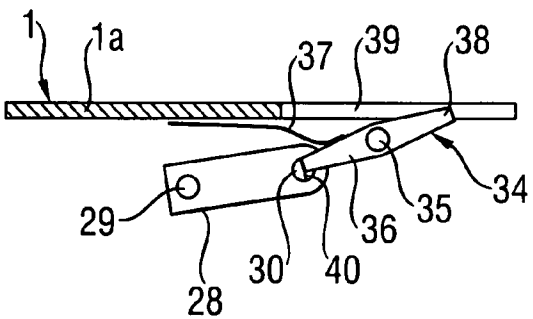
FIG. 5 shows the position of the locking latch in the state of FIG. 4.

FIGS. 4 and 5 represent the working tool in the pressed state; in other words, when it is pressed against an object 55 with its piston guide 11 or its muzzle and shortly after firing (the piston 6 represented in broken lines); thus, when it has been moved forward.

According to FIG. 4, the working tool is pressed against an object 55 with its piston guide 11; that is, with its tip or muzzle. Since the piston guide 11 is situated in the guide cylinder 5, it is carried along with it. The guide cylinder 5 is thus displaced at the farthest rear point and now impacts with the front edge of the axial longitudinal slot 7 forward against the stop 8. In this case, the funnel-shaped, rear opening firing chamber 15 is displaced over a firing cartridge 16 situated in the firing position. At the same time, the extension spring 5*a* is compressed. With the movement of the guide cylinder 5 from the position shown in FIG. 2 into the position shown in FIG. 1, the ram spring 23 is also compressed, since the ram 21 abuts on the stopper 33 via the engagement part 28. On the other hand, with the movement of the guide cylinder 5 towards the rear in FIG. 4, the connecting piece is similarly carried towards the rear opposite to the direction of advance of the piston or the setting direction 6, which results in that the axial stub 29 of the engagement part 28 runs into the forward zone 27 of the longitudinal slot 26. This results in a pivoting of the engagement part 28 counter-clockwise in FIG. 4 and about the axial stub 30, which in turn has the effect that the boss 31 connected with the engagement part 28 is pivoted out of the inside of the guide cylinder 5 and consequently releases the piston 9 track. Simultaneous with the rear shifting of the guide cylinder 5 or away from the muzzle, the locking latch connected with it also moves towards the rear; that is, it is carried with it. It now comes to rest with its rear end 39 in the longitudinal slot 39, so that the compression spring 37 connected to the guide cylinder 5 can rotate the locking latch 34 counter-clockwise in FIG. 5 about the axis 35. In this offset position of the guide cylinder 5, the front end 36 of the locking latch 34 comes to rest in front of the pivoted tangential surface 40 of the axial stub 30, whereby the rotary position of the engagement part 28 is locked. At this point, it is noted that in the later displacement of the guide cylinder 5 forward, the engagement part 28 is carried along by the locking latch 34 and the axial stub 30.

If firing of the cartridge 15 now occurs by operating the trigger 3 or the push-button switch, then the piston 9 is driven in the direction of advance of the piston 6 and runs with its piston rod 10 into the piston guide such that the fastening element 4 is driven out. The piston 9 is now situated in FIG. 4 in the position indicated by the broken lines. It doe not yet strike against the stop 8, because its forward movement is braked by the braking assembly 13, 14.

Figures 6, 7:
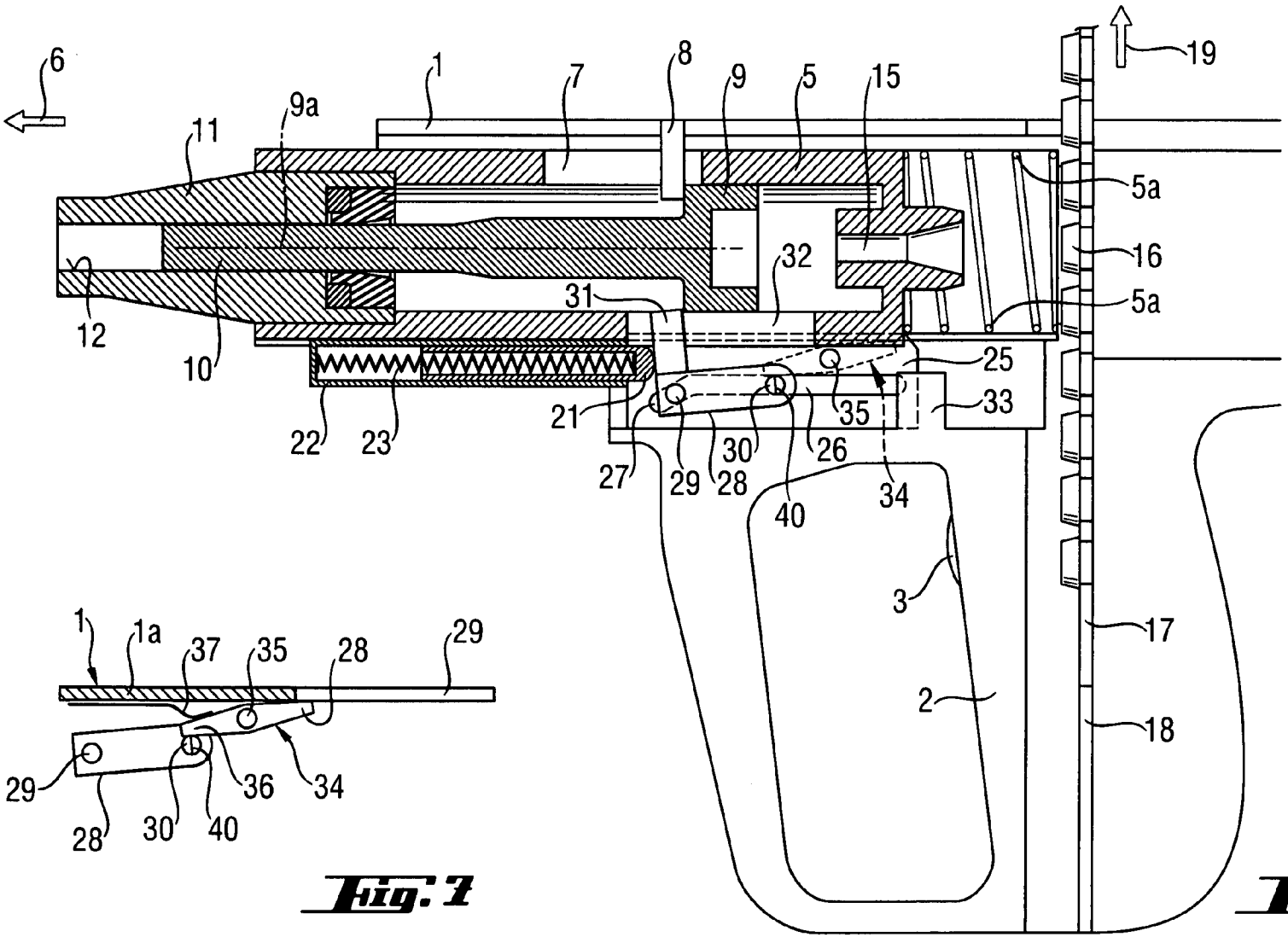
FIG. 6 shows the working tool of FIG. 1 in section upon return of the piston along the first half of the piston stroke.
FIG. 7 shows the position of the locking latch in the state according to FIG. 6.

As soon as the working tool with its piston guide 1 is removed from the objects, the guide cylinder 5, by the extension spring 5*a* is withdrawn again from the working tool in the direction of advance of the piston 6, so that the state represented in FIGS. 6 and 7 can be assumed. Upon extension of the guide cylinder 5 under the action of the extension spring 5*a*, the rear surface of the axial longitudinal slot 7 moves into the vicinity of the stop 8. In this movement of the guide cylinder 5, the piston 9 is accordingly carried along by friction and run up against the stop 8 and initially fixed in its position by same.

With the movement of the guide cylinder 5 in the direction of advance of the piston 6 as a result of the action of the extension spring 5*a*, the locking latch 34 is also carried along in the direction of advance of the piston 5 and carries the engagement part 28 over the tangential surface 40 initially also in the direction of advance of the piston 6. At the same time, however, the connecting piece 25 and the ram chamber 22 are also carried in the direction of advance of the piston, because they are connected to the guide cylinder 5. Accordingly, nothing changes initially in the relative position of the locking latch 34, engagement part 28, connecting piece 25 and ram 21. Only when the boss 31 of the engagement part 28 on the piston 9 passes by or has just passed by in the direction of advance of the piston 6, does the rear end 38 of the locking latch 34 exit on the ramp formed by the wall segment 1*a* or out of the longitudinal slot 39, which results in the locking latch 37 being tensioned, as seen in FIG. 7. By virtue of this, the front end 36 of the locking latch 34 disengages from the tangential surface 40 on the axial stub 30. The rear front edge of the axial longitudinal slot 7 is now situated in the vicinity of the rear side of the stop 8. As long as the boss 31 has not completely moved past the piston, the ram 21 cannot urge the engagement part 28 rear to the stopper 33, because the front axial stub 29 is still situated angled downward in the zone 27 of the longitudinal slot 26. A displacement of the engagement part 28 by the ram 21 would then still not be possible, because in such a case the boss 31 would be urged laterally against the piston 8, which would be equivalent to a blocking. The extension spring 5*a* thus serves for the displacement of the connecting piece 25 being effected in the direction of advance of the piston such that the angled segment 27 of the longitudinal slot 26 comes to rest in front of the piston so that the boss 31 can grip same.

After extension spring 5*a* has displaced the guide cylinder or the connecting piece 25 connected with it in the direction of advance of the piston 6 so far that the boss 31 by lifting the axial stub 29 over the inclinedly running segment 27 of the longitudinal slot is guided in front of the piston, and especially under the action of the ram 21, the ram 21 can now displace the engagement part 8 and with it the boss 31 in the direction towards the rear end of the working tool, whereby the axial stubs 29, 30 now run in the horizontal longitudinal slot 26. With this movement, the piston 9 is moved over the boss 31 and likewise rear in the guide cylinder 5, until it has again reached its starting position there and the piston 9 covers the firing chamber 15. Now, the state according to FIGS. 2 and 3 are again reached.

A second exemplary embodiment of a working tool according to the invention is more completely described in the following with reference to the FIGS. 8 to 11. Identical parts to those in FIGS. 1 to 7 are provided with the same references and will not be described again.

Figure 8:
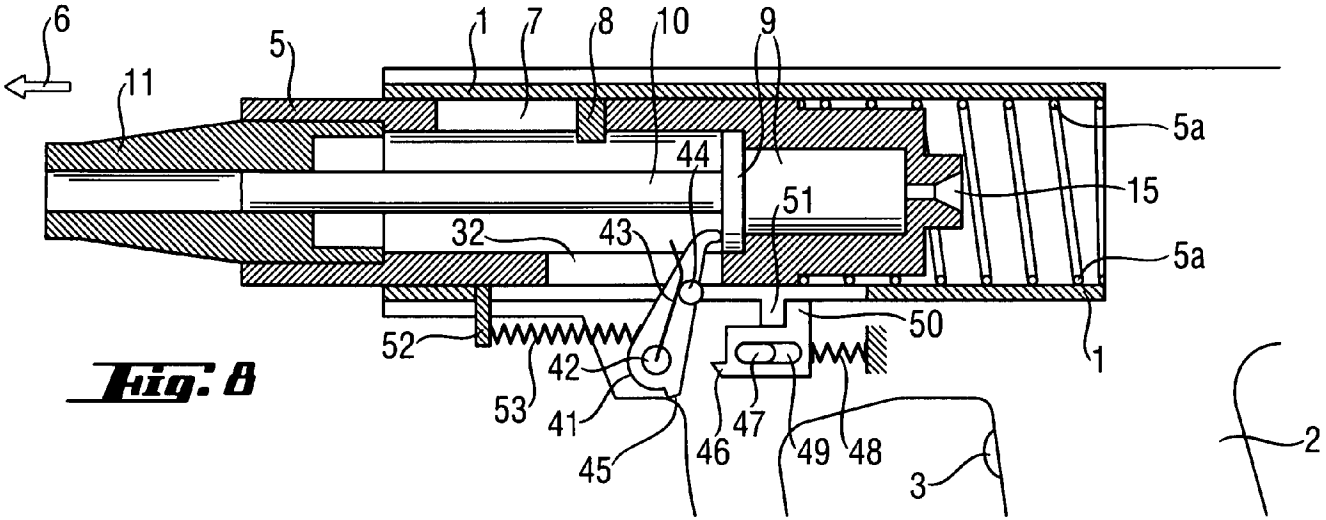
FIG. 8 shows an axial section through a working tool according to a second exemplary embodiment of the invention in section, wherein the working tool is situated in the non-pressed state.

As an engagement piston 9 a pivotably mounted lever 41 protrudes through the axial slot 32 in the peripheral wall of the guide cylinder 5. This lever 41 can be pivotably mounted on an axis of rotation 42, which is situated outside of the guide cylinder 5 and stands vertical to its central axis. In this case, the axis of rotation 42 is mounted on the guide cylinder 5 and displaceable in its longitudinal direction. From the rotational axis 42, the lever 41 extends armlike through the axial slot 32 and into the inside of the guide cylinder 5; accordingly, it projects into the track of the piston 9 and can be seen to come to rest with its tip in the direction of advance of the piston 6 in front of the piston 9. This is shown in FIG. 8. Further, an arm or relatively rigid arm 4 is connected with the axis of rotation 42, which from the rotational axis 42 also extends in the longitudinal direction of the pivotable lever 41 and protrudes into the position shown in FIG. 8 in the axial slot 32. The arm or the spring arm 43 is fixed with the axis of rotation 42 such that a swivel movement of the spring arm 43 is transmitted in a plane including the central axis of the guide cylinder 5 via the axis of rotation 42 on the lever 41, whereby it is accordingly carried along. Accordingly, in FIG. 8, the spring arm 43 is swiveled counter-clockwise about the axis of rotation 42, this applies also to the lever 41 and in the opposite direction. The swiveling of the spring arm 43 occurs by virtue of an engagement part 44 situated in the track of the spring arm 43, which is fixed on the device housing 1. This engagement part 44 lies similar to the spring arm 43 alongside the lever 41 or is displaced relative to same in the longitudinal direction of the rotational axis 42.

Accordingly, in FIG. 8, the guide cylinder 5 is displaced to the right, the rotational axis 42 is also shifted to the right, because it is mounted on the guide cylinder 5. The rotational axis 42 runs underneath and along. The engagement part 44 runs in the direction towards the rear end of the working tool such that the spring arm 43 and swivels counter to the engagement part 44 and counter-clockwise and with it then the swivel lever 41. If, in this fashion, the pivotable lever 41 was sufficiently swiveled, a detent boss 45 of the swivelable lever 41 reaches the vicinity of the rotational axis 42 in contact with a locking latch 46, which is displaceably mounted on a boss 47 similarly on the guide cylinder 5 and is carried along by same. A spring 48 fasted to the guide cylinder 5 tends to urge the lock latch 46 on the boss 47 in the direction of advance of the piston 6. When this is done, the boss 47 lies in a longitudinal opening 49 of the lock latch 46 extending in an axial direction of the guide cylinder 5. The lock latch 46 still has a projection 50 oriented towards the guide cylinder 5, which viewed in the direction of advance of the piston 6 is urged against a stop 51 fastened to the housing 1 and this is done by the spring 48.

A compression spring 53 is situated between a boss 52 fastened to the guide cylinder 5 and the swivelable lever, said spring constantly attempting to rotate the lever 41 clockwise, as shown in FIG. 8, about the rotational axis 42. The compression spring 53 thus urges the lever 41 always to the right in FIG. 8.

In the following, the mode of operation of this working tool win a second exemplary embodiment will be described in more detail.

FIG. 8 represents the working tool in the idle position. It is thus not pressed with its tip or piston guide 11 against an object. The extension spring 5*a* has displaced the guide cylinder 5 completely in the direction of advance of the piston 6, whereby the rear side of the axial longitudinal slot 7 impacts against the stop 8. The piston lies opposite to the direction of advance of the piston 6 in its rearmost position in the guide cylinder 5 and seals the firing chamber 15. It is held in this position by the pivotable lever 41, which under the action of the compression spring 53 is biased clockwise about the axis of rotation 42. The lock boss 45 and the lock latch 46 are not engaged, whereby the compression spring 48 urges the lock latch 46 over the projection 50 against the stop 51.

Figure 9:
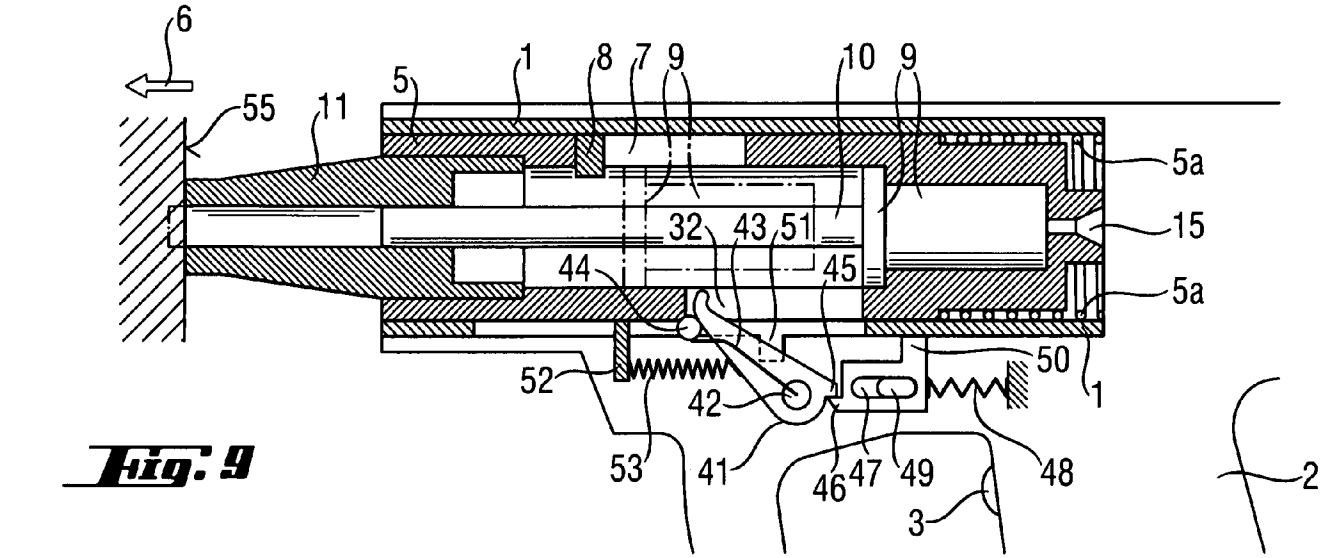
FIG. 9 shows the working tool of FIG. 8 in section in the pressed state and after firing.

FIG. 9 represents a state, in which the working tool has been urged with its piston guide 11 or muzzle against an object 55. The piston guide 5 is thus urged opposite to the direction of advance of the piston 6 into the inside of the working tool and accordingly has carried the guide cylinder 5 rear such that it now receives a cartridge (not shown) with its firing chamber 15 in the firing position. The extension spring 5*a* is not completely compressed. As a result of the displacement of the guide cylinder 5 opposite to the direction of advance of the piston 6 relative to the device housing 1, the spring arm 43 moves against the engagement part 44 and turned, upon further movement of the guide cylinder 5, counter-clockwise about the axis 42 and, as shown especially in FIG. 9, into the end position. The compression spring 53 is compressed by virtue of this rotation of the lever 41. By virtue of this rotation of the lever 41 the compression spring 3 is compressed. The rotation of the lever 41 counter-clockwise about the axis of rotation 42 in FIG. 9 continues until the latch boss 45 is raised over the lock latch 46 in the direction of advance of the piston 6 is shifted completely on the boss 47, so that the lock boss 45 and the lock latch 46 can come into engagement. The shift of the lock latch 46 in the direction of advance of the piston 6 is no longer obstructed by the boss 51, because the projection 50 is in the meantime, as a result of the displacement of the guide cylinder 5, is removed from the stop 51. The lever 41 is now, as a result of the locking by the element 45 and 46, held in a rotational position, in which it no longer projected into the inside of the guide cylinder 5 and releases the track of the piston 9. If the setting tool is now fired, the piston 9 can be moved in the direction of advance of the piston 6 to drive a fastening element (not shown) out of the piston guide 11 and into the object 55. The piston 9 now assumes the position shown in broken lines.

Figure 10:
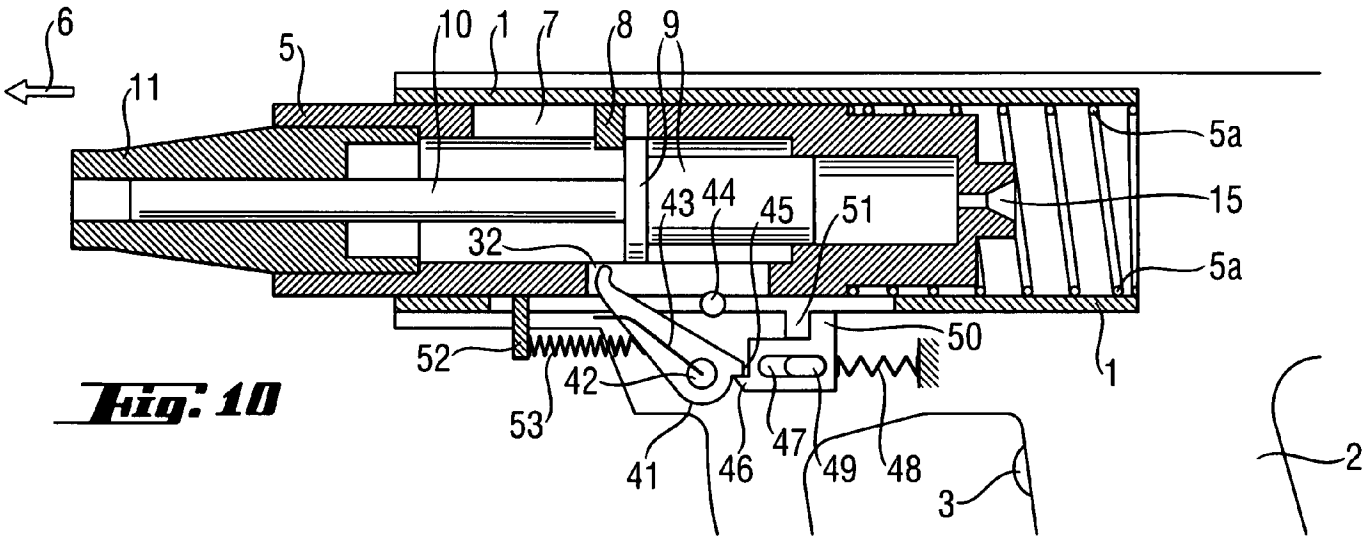
FIG. 10 shows the working tool of FIG. 8 in section after advance of the guide cylinder, wherein the engagement part is still latched.

According to FIG. 10, the working tool is again removed from the object and the extension spring 5*a* urges the guide cylinder 5 and with it moves the piston guide 11 back into the direction of advance of the piston 6. By virtue of the friction, the piston 9 is carried along until it runs up against the stop 8. The position of the stop 8 in the axial direction of the working tool is selected so that the free end of the direction in advance of the piston 6 of the swiveled lever 41 brought to rest, viewed in the direction of advance of the piston 6, in front of the piston 9, where it abuts the stop 8. FIG. 10 represents this state. The lever 41 continues to be held in its locked position.

Figure 11:
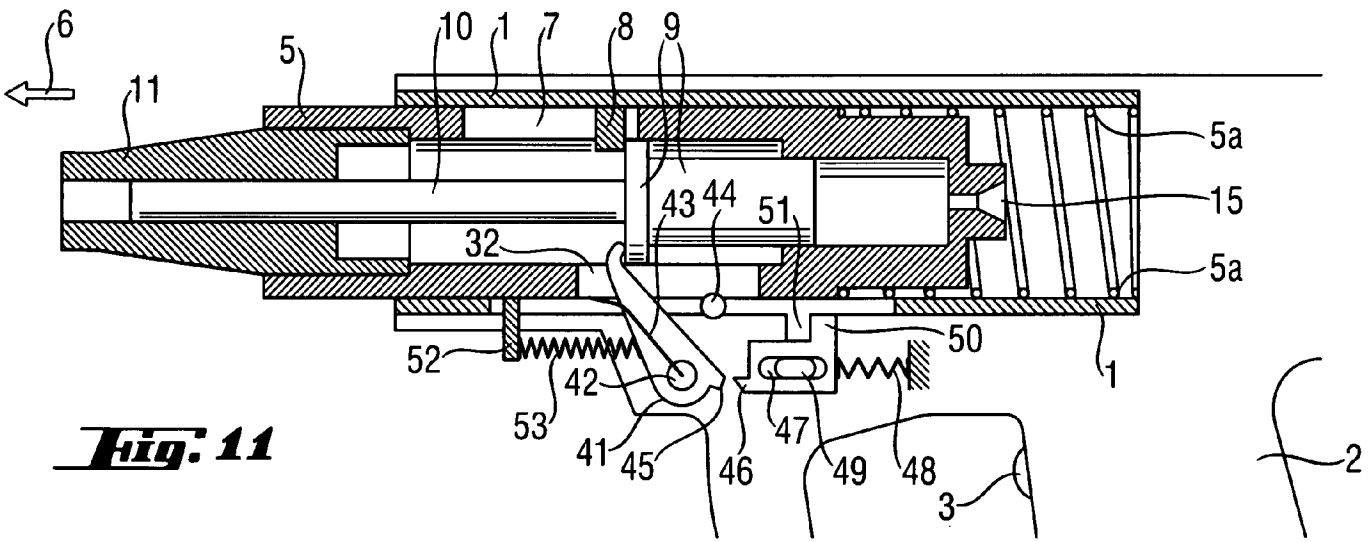
FIG. 11 shows the working tool of FIG. 8 in section in a state, wherein the guide cylinder is shifted in the direction of advance of the piston and the engagement part grips the piston for return guidance over the second half of the piston stroke.

With a further displacement of the guide cylinder 5 in the direction of advance of the piston 6, it likewise runs up against the stop 8, as shown in FIG. 11. When this is done the projection 50 also runs against the stop 51 fixed to the device housing, so that it is released. To achieve this, the lock latch 46 is shifted via 50/51 against the direction of advance of the piston 6 and counter to the force of the spring 48 and accordingly releases the lock boss 45. The spring 53 can now swivel the lever 41 about the axis of rotation 42 clockwise according to FIG. 11. When this is done, the lever 41 moves with its tip into the inside of the guide cylinder 5 and carries the piston 9 to the rear end of the guide cylinder 5. When this is done, the spring arm 43 finally impacts upon the engagement part 44, which is affixed to the housing, which causes the compression spring 53 moves the guide cylinder 5 yet a short distance forward in the direction of advance of the piston 6 up to the stop 8. With this, the state according to FIG. 8 is again reached.

What is claimed is:

1. A combustion-operated working tool including a setting tool for fastening elements comprising:

a housing (1);

a guide cylinder (5) axially displaceable relative to the device housing (1);

a piston (9) mounted displaceable in the guide cylinder (5);

a stop (8) integral with the device housing projecting into the guide cylinder (5) to delimit an engagement of the piston (9) in a direction of advance of the piston (6) when the guide cylinder (5) is shifted in the direction of advance of the piston (6);

an elastic adjusting element (21–23); 52, 53) that is connected to the guide cylinder (5) and is tensioned upon movement of the guide cylinder (5) into the tool housing (1); and an engagement part (28, 31, 41) for engaging the piston (9) in a direction opposite the direction of advance of the piston (9), wherein upon movement of the guide cylinder (5) out of the tool housing (1), the engagement part (28, 31, 41) is driven by the elastic adjusting element (21–23, 52, 53) for engaging the piston (9) in a direction opposite the direction of advance of the piston (9).

2. The working tool of claim 1, wherein the engagement part (28, 31, 41) is mounted on the guide cylinder (5) such that it can be at least one of swiveled and displaced.

3. The working tool of claim 1, wherein the engagement part (28, 31; 41) can be locked and unlocked and moved out of the piston track (9), after the guide cylinder (5) is shifted into the direction of advance of the piston (6) and the engagement part (28, 31; 41) has again reached its piston carrying position.

4. The working tool of claim 3, wherein the elastic adjusting element (21–23; 52, 53) is arranged between the guide cylinder (5) and the engagement part (28, 31; 41).

5. The working tool of claim 4, wherein the engagement part (28, 31) is guided in a connecting part (25) fixed to the guide cylinder (5).

6. The working tool of claim 5, wherein the engagement part (28, 31) is guided into a longitudinal slot (28) extending in the direction of advance of the piston (6) of the connecting part (25) via two studs (29, 30) spaced apart from each other and that is at the forward lying end (27) of the longitudinal slot (26) direction of advance of the piston (6) away from the axis (9*a*) of the piston (9).

7. The working tool of claim 6, wherein the engagement part (28, 31) can be moved opposite to the direction of advance (6) against a stop (330 integral with the device housing.

8. The working tool of claim 7, wherein a locking latch (34) is pivotably mounted on the guide cylinder (5) having one end (36) for locking the engagement part (28, 31) in a position outside of the path of the piston (9) and another end (38) being operated by a ramp (1*a*) on the device housing (1) to remove the locking of the engagement part (28, 31).

9. The working tool of claim 8, wherein the rear stud (30) of the engagement part (28, 31) has a tangential surface (40) in the direction of advance of the piston (6), which the one end (36) of the latch (34) can be swiveled in front of the tangential surface (40).

10. The working tool of claim 9, wherein said one end (36) of the locking latch (34) is pre-biased in the direction towards the longitudinal slot of the connecting piece (26).

11. The working tool of claim 4, wherein the engagement part (41) is a lever that can be swiveled about an axis (42) mounted on the guide cylinder (5).

12. The working tool of claim 11, wherein a housing-integral stop (44) is present for pivoting the engagement part (41).

13. The working tool of claim 12, wherein the engagement part (41) can be swiveled by an arm (41) connected to one of the engagement part (41) and an axis (42) of the engagement part (41) that can be moved against the housing—integral stop (44).

14. The working tool of claim 12, further comprising a locking latch (46) displaceable against a boss (47) of the guide cylinder (5) for locking the engagement part (41) in a position pivoted out of the path of the piston (6).

* * * * *